US008188817B2

(12) United States Patent
Shen

(10) Patent No.: US 8,188,817 B2
(45) Date of Patent: May 29, 2012

(54) ELECTROMECHANICAL RELAY AND METHOD OF MAKING SAME

(75) Inventor: Jun Shen, Phoenix, AZ (US)

(73) Assignee: Magvention (Suzhou) Ltd., Suzhou (CN)

( * ) Notice: Subject to any disclaimer, the term of this patent is extended or adjusted under 35 U.S.C. 154(b) by 150 days.

(21) Appl. No.: 12/719,400

(22) Filed: Mar. 8, 2010

(65) Prior Publication Data

US 2010/0231333 A1 Sep. 16, 2010

Related U.S. Application Data

(60) Provisional application No. 61/159,169, filed on Mar. 11, 2009.

(51) Int. Cl.
*H01H 51/22* (2006.01)
*H01H 57/00* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 4,668,928 A * 5/1987 Davis et al. ..... 335/79
5,994,986 A * 11/1999 Takahashi ..... 335/78
6,124,771 A * 9/2000 Kim et al. ..... 335/4
6,492,887 B1 * 12/2002 Diem et al. ..... 335/78
6,538,540 B2 * 3/2003 Oberndorfer et al. ..... 335/78
6,633,158 B1 * 10/2003 Shen et al. ..... 324/207.26
6,633,212 B1 * 10/2003 Ruan et al. ..... 335/78
6,639,493 B2 * 10/2003 Shen et al. ..... 335/78
6,750,745 B1 * 6/2004 Wei et al. ..... 335/78
6,794,965 B2 * 9/2004 Shen et al. ..... 335/78
7,023,304 B2 * 4/2006 Shen et al. ..... 335/78
7,049,904 B2 * 5/2006 Shin ..... 333/105
7,151,426 B2 * 12/2006 Stafford et al. ..... 335/78
7,301,334 B2 * 11/2007 Shen et al. ..... 324/207.26
2002/0140533 A1 * 10/2002 Miyazaki et al. ..... 335/78
2005/0007218 A1 * 1/2005 Shen et al. ..... 335/78
2007/0075809 A1 * 4/2007 Shen et al. ..... 335/78

* cited by examiner

*Primary Examiner* — Lincoln Donovan
*Assistant Examiner* — Alexander Talpalatskiy

(57) ABSTRACT

A double-pole-double-throw (DPDT) electromechanical relay employing a movable first magnet and a nearby third electromagnet is disclosed. The movable first magnet is permanently magnetized with a magnetic moment and has at least a first end and a second end. The third electromagnet, when energized, produces a third magnetic field which is primarily perpendicular to the magnetization direction of the first movable magnet and exerts a magnetic torque on the first magnet to force the first magnet to rotate and closes electrical conduction paths at the first end. Changing the direction of the electrical current in the third electromagnet changes the direction of the third magnetic field and thus the direction of the magnetic torque on the first magnet, and causes the first magnet to rotate in an opposite direction and opens the electrical conduction path at the first end and closes the electrical conduction paths at the second end. Latching, non-latching types, and various forms (normally open or closed, etc.) of relays can be formed by appropriately adjusting various force magnitudes.

16 Claims, 6 Drawing Sheets

Cross-sectional view of upper part 200A.

3D view of lower part 200B.

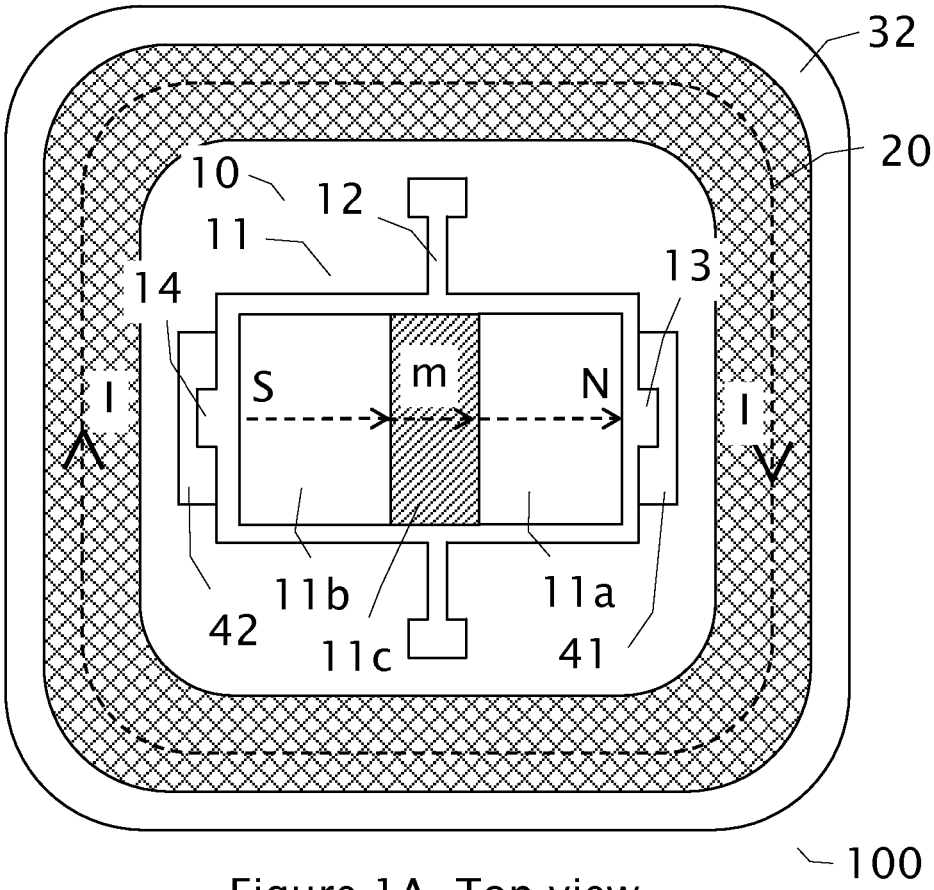
Figure 1A. Top view.
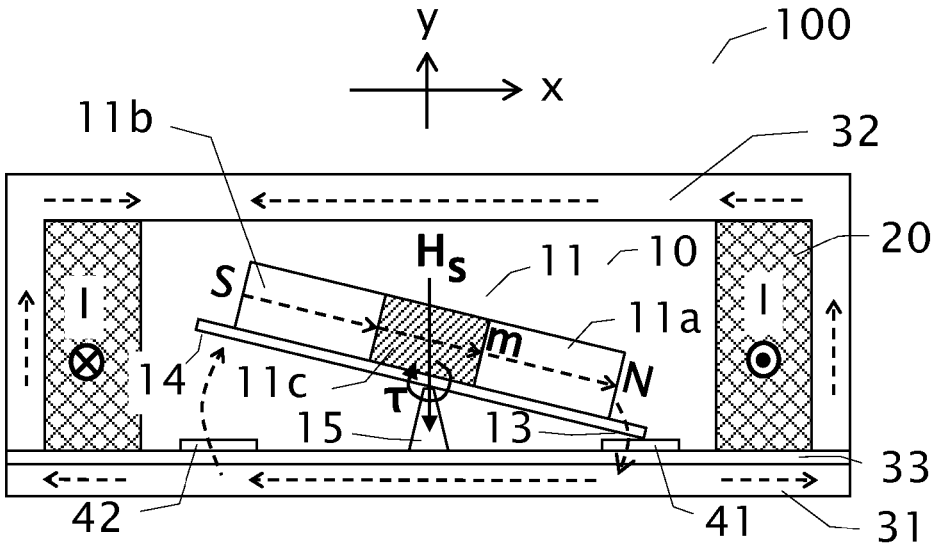
Figure 1B. Front view.

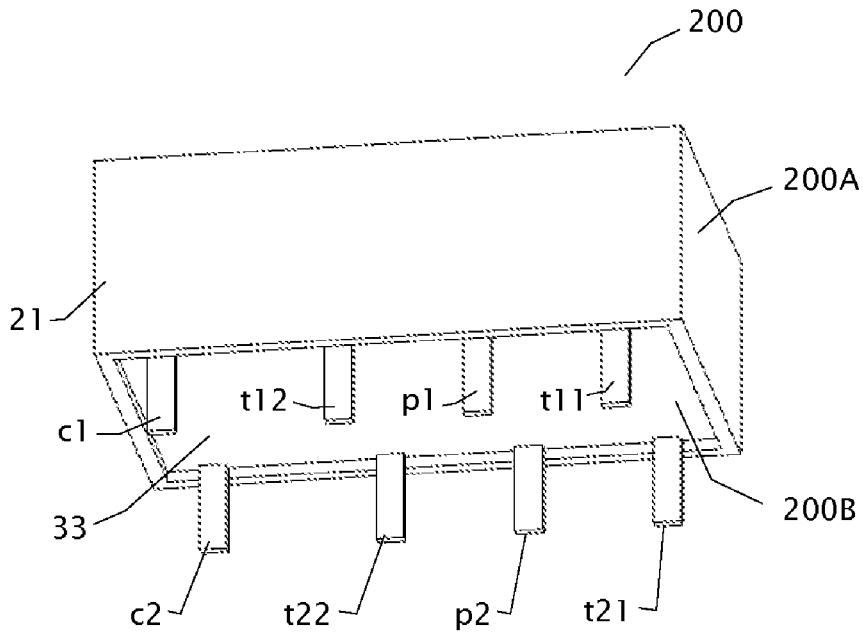
Figure 2A. Assembled 3D view.
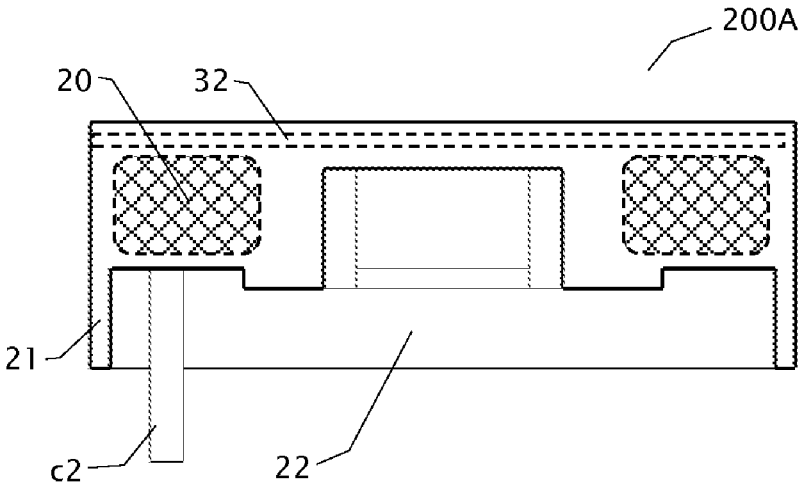
Figure 2B. Cross-sectional view of upper part 200A.

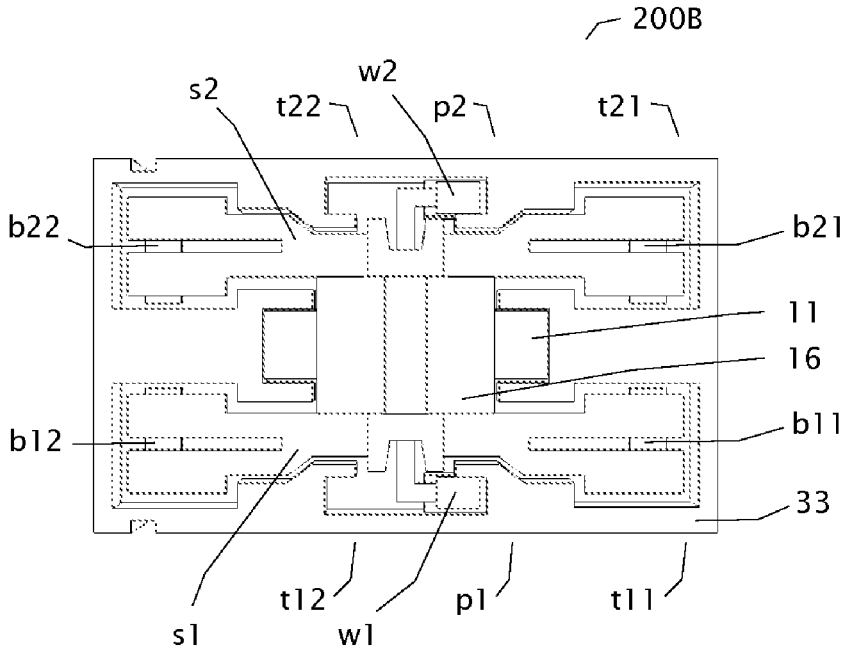
Figure 2C. Top view. Of lower part 200B
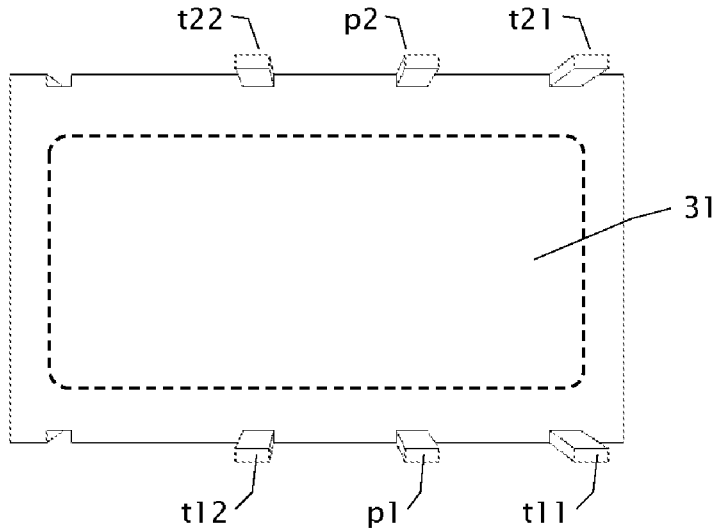
Figure 2D. Bottom view of lower part 200B.

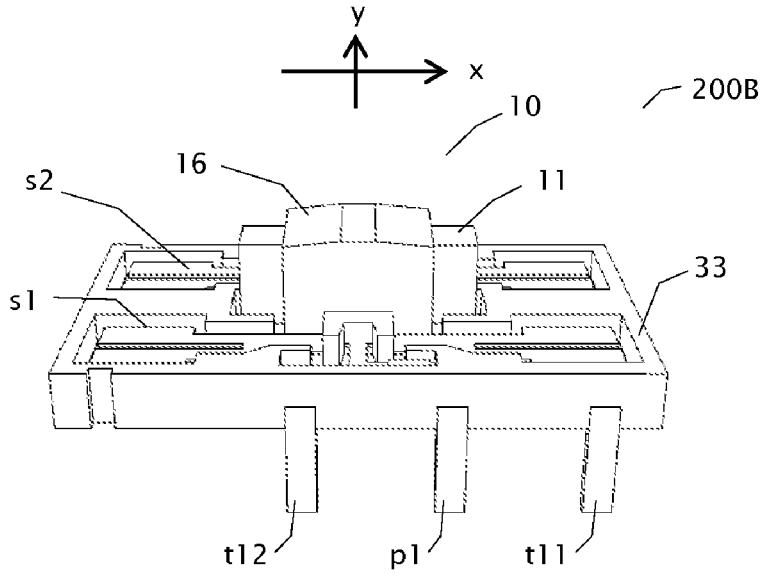
Figure 2E. Front perspective view of lower part 200B.
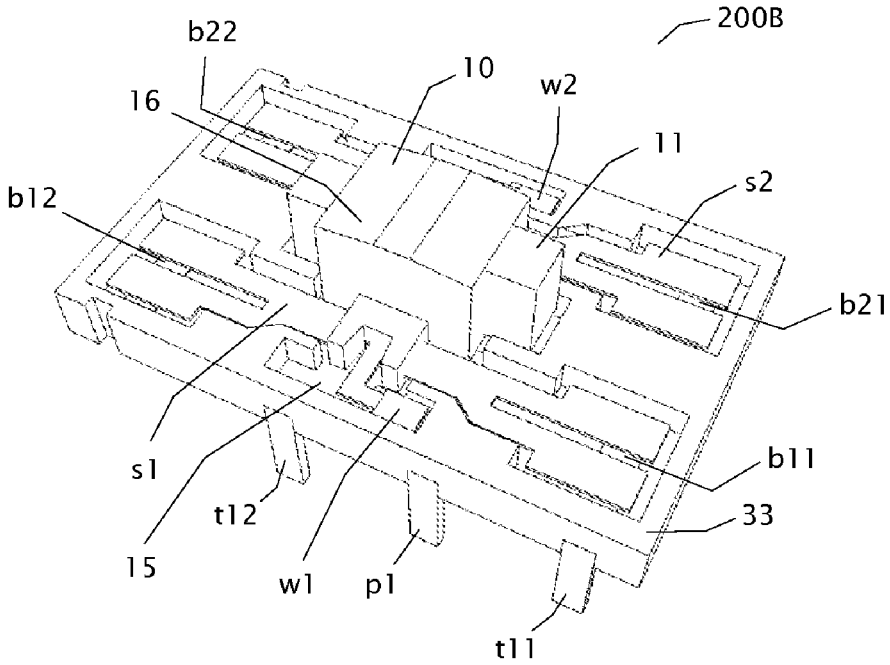
Figure 2F. 3D view of lower part 200B.

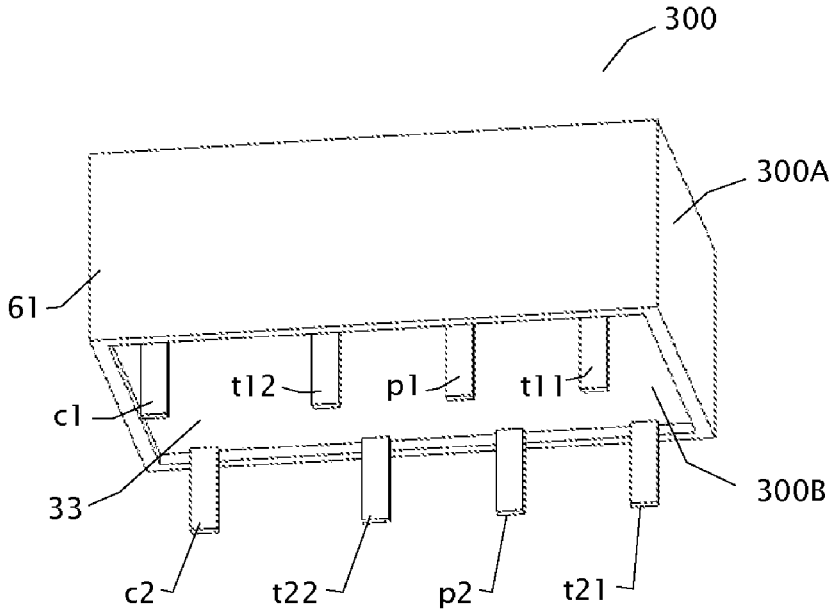
Figure 3A. Assembled 3D view.
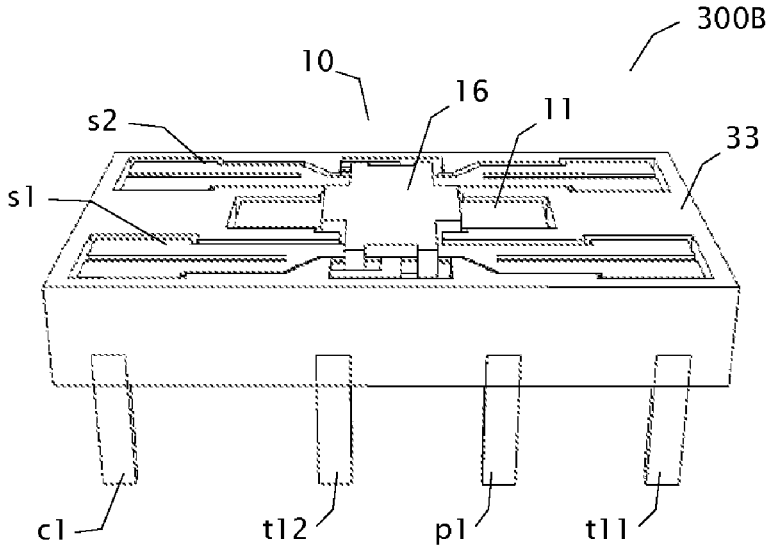
Figure 3B. Front perspective view.

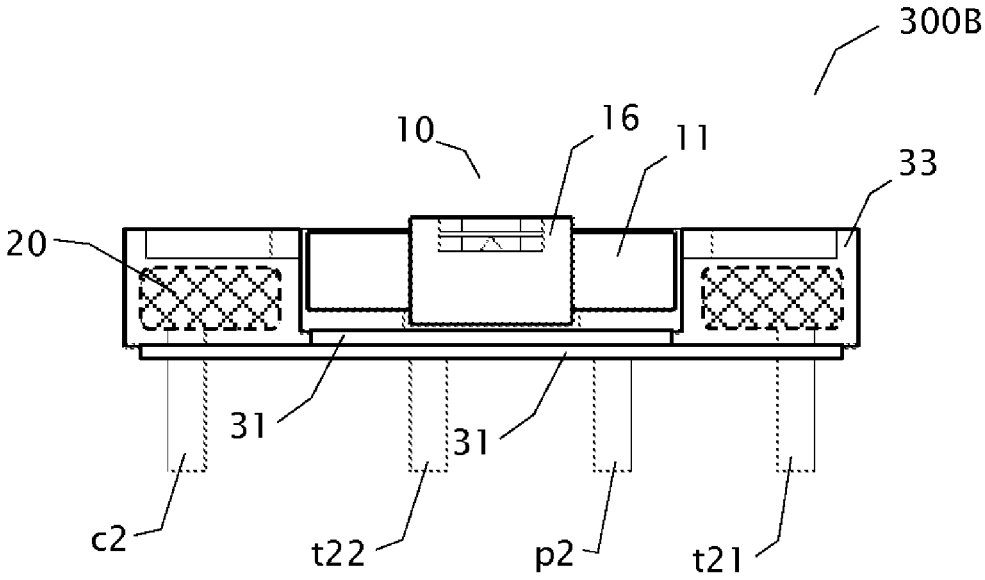
Figure 3C. Cross-sectional view of lower part 300A.
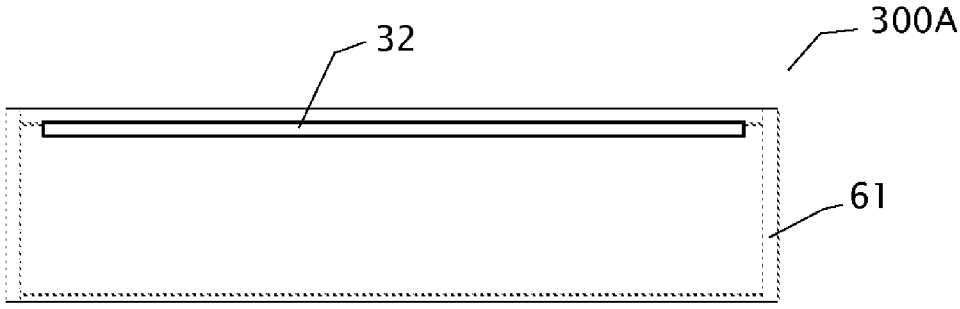
Figure 3D. Cross-sectional view of upper part 300B.

ELECTROMECHANICAL RELAY AND METHOD OF MAKING SAME

CROSS-REFERENCE TO RELATED APPLICATIONS

This patent application claims the benefit of U.S. Provisional Patent Application Ser. No. 61/159,169, filed on Mar. 11, 2009, which is hereby incorporated by reference. This application is related to application Ser. No. 11/534,655, filed on Sep. 24, 2006, now U.S. Pat. No. 7,482,899 B2, issued on Jan. 27, 2009.

FIELD OF THE INVENTION

The present invention relates to relays. More specifically, the present invention relates to double-pole-double-throw (DPDT) and other multi-pole-multi-throw (MPDT) electromechanical relays and to methods of making DPDT and other MPDT electromechanical relays.

BACKGROUND OF THE INVENTION

Relays are electromechanical switches operated by a flow of electricity in one circuit and controlling the flow of electricity in another circuit. A typical relay consists basically of an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position. Variations on this mechanism are possible: some relays have multiple contacts; some are encapsulated; some have built-in circuits that delay contact closure after actuation; some, as in early telephone circuits, advance through a series of positions step by step as they are energized and de-energized, and some relays are of latching type.

Relays are classified by their number of poles and number of throws. The pole of a relay is the terminal common to every path. Each position that the pole can connect to is called a throw. A relay can be made of n poles and m throws. For example, a single-pole-single-throw relay (SPST) has one pole and one throw. A single-pole-double-throw (SPDT) relay has one pole and two throws. A double-pole-double-throw (DPDT) relay has two poles, each with two simultaneously controlled throws.

Relays are then classified into forms. Relay forms are categorized by the number of poles and throws as well as the default position of the relay. Three common relay forms are: A, B, and C. Form A relays are SPST with a default state of normally open. Form B relays are SPST with a default state of normally closed. Form C relays are SPDT and break the connection with one throw before making contact with the other (break-before-make).

Latching relays are the types of relays which can maintain closed and open contact positions without energizing an electromagnet. Short current pulses are used to temporally energize the electromagnet and switch the relay from one contact position to the other. An important advantage of latching relays is that they do not consume power (actually they do not need a power supply) in the quiescent state.

A recent U.S. patent (U.S. Pat. No. 7,482,899 B2) describes a new type of electromechanical relay which employs a movable first magnet and a nearby third electromagnet. The movable first magnet is permanently magnetized with a magnetic moment and has a first end and a second end. The third electromagnet, when energized, produces a third magnetic field which is primarily perpendicular to the magnetization direction of the first movable magnet and exerts a magnetic torque on the first magnet to force the first magnet to rotate and closes an electrical conduction path at the first end. Changing the direction of the electrical current in the third electromagnet changes the direction of the third magnetic field and thus the direction of the magnetic torque on the first magnet, and causes the first magnet to rotate in an opposite direction and opens the electrical conduction path at the first end and closes an electrical conduction path at the second end. A second magnet is provided to hold the first magnet in a stable position.

A purpose of the present invention is to provide a new and improved electromechanical relay which is in the form of double-pole-double-throw.

SUMMARY OF THE INVENTION

A double-pole-double-throw electromechanical relay comprises a movable first magnet and a nearby third electromagnet (e.g., a coil or solenoid). The movable first magnet is permanently magnetized and has a first end and a second end. The third electromagnet, when energized, produces a third magnetic field which is primarily perpendicular to the magnetization direction of the first movable magnet and exerts a magnetic torque on the first magnet to force the first magnet to rotate and closes two independent electrical conduction paths at the first end. Changing the direction of the electrical current in the third electromagnet changes the direction of the third magnetic field and thus the direction of the magnetic torque on the first magnet, and causes the first magnet to rotate in an opposite direction and opens the two electrical conduction paths at the first end and closes two other independent electrical conduction paths at the second end. Latching and non-latching types of relays in various forms (A, B, and C) can be formed by appropriately using soft and permanent magnets as various components.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 1A is a top view of an exemplary embodiment of an electromechanical relay;

FIG. 1B is a front view of an exemplary embodiment of an electromechanical relay;

FIGS. 2A to 2F are various views of an exemplary embodiment of a double-pole-double-throw (DPDT) electromechanical relay;

FIGS. 3A to 3D are various views of another exemplary embodiment of a double-pole-double-throw (DPDT) electromechanical relay;

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical latching relays may be spatially arranged in any orientation or manner. Arrays of these relays can also be formed by connecting them in appropriate ways and with appropriate devices.

FIGS. 1A and 1B show top and front views, respectively, of an electromechanical relay. With reference to FIGS. 1A and 1B, an exemplary electromechanical relay 100 suitably comprises a movable body 10, a coil 20, soft magnetic layers 31 and 32, electrical contacts 41 and 42, and a substrate 33.

Movable body 10 comprises a magnetic body 11 (first magnet), flexure spring and support 12, a pivot 15, and electrical contacts 13 and 14. Magnetic body 11 (first magnet) comprises permanent (hard) magnetic material and is permanently magnetized primarily along the positive x-axis when said first magnet 11 lies leveled. Other magnetization orientation of magnetic layer 11 is also possible as long as it achieves the function and purpose of this invention. Movable body 10 has a first (right) end associated with the first (right) end of first magnet 11 and contact 13, and has a second (left) end associated with the second (left) end of first magnet 11 and contact 14. The permanent (hard) magnetic material in first magnet 11 can be any type of hard magnetic material that can retain a remnant magnetization in the absence of an external magnetic field and its remnant magnetization cannot be easily demagnetized. In an exemplary embodiment, the permanent (hard) magnetic material is SmCo with an approximate remnant magnetization ($B_r=\mu_0 M$) of about 1 T predominantly along the positive x-axis when it lies leveled. Other possible hard magnetic materials are, for example, NdFeB, AlNiCo, Ceramic magnets (made of Barium and Strontium Ferrite), CoPtP alloy, and others, that can maintain a remnant magnetization ($B_r=\mu_0 M$) from about 0.001 T (10 Gauss) to above 1 T ($10^4$ Gauss), with coercivity ($H_c$) from about $7.96\times10^2$ A/m (10 Oe) to above $7.96\times10^5$ A/m ($10^4$ Oe). First magnet 11 has a magnetic moment m predominantly along the positive x-axis when first magnet 11 lies leveled. Flexure spring and support 12 can be any flexible material that on one hand supports movable body 10 and on the other allows body 10 to be able to move and rotate. Flexure spring and support can be made of metal layers (such as Beryllium Copper, Ni, stainless steel, etc.), or non-metal layers (such as polyimide, Si, $Si_3Ni_4$, etc.). The flexibility of the flexure spring can be adjusted by its thickness, width, length, shape, and elasticity, etc. Pivot 15 further supports movable body 10 to maintain a gap between body 10 and soft magnetic layer 31. Pivot 15 can be placed on the top of body 10 to maintain a gap between body 10 and soft magnetic layer 32. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of body 10 by electroplating, deposition, welding, lamination, or any other suitable means. Flexure spring and support 12 and electrical contacts 13 and 14 can be formed by either using one process and the same material, or by using multiple processes, multiple layers, and different materials. When body 10 rotates and its two ends move up or down, electrical contact 13 (or 14) either makes or breaks the electrical connection with the bottom contact 41 (or 42). Optional insulating layers (not shown) can be placed between the conducting layers to isolate electrical signals in some cases.

Coil 20 (third electromagnet) is formed by having multiple windings of conducting wires around body 10. The conducting wires can be any conducting materials such as Cu, Al, Au, or others. The windings can be formed by either winding the conducting wires around a bobbin, or by electroplating, deposition, screen printing, etching, laser forming, or other means used in electronics industry (e.g., semiconductor integrated circuits, printed circuit boards, etc.). One purpose of coil 20 in relay 100, when energized, is to provide a third vertical (along y-axis) magnetic field ($H_s$) so that a magnetic torque ($\tau=\mu_0 m\times H_s$) can be created on body 10. Because the magnetic moment m in first magnet 11 is fixed, the direction and magnitude of the torque depends on the direction and magnitude of the current in coil 20. This arrangement provides a means for external electronic control of the relay switching between different states, as to be explained in detail below.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. One purpose of soft magnetic layers 31 and 32 is to form a closed magnetic circuit (indicated by dashed lines with arrows in FIG. 1B) and enhance the coil-induced magnetic flux density (third vertical magnetic field $H_s$) in movable body 10 region. Another purpose of soft magnetic layers 31 and 32 is to cause an attractive force between a pole of first magnetic layer 11 and the induced local opposite magnetic pole of the soft magnetic layer so that a stable contact force can be maintained between electrical contact 13 (or 14) and electrical contact 41 (or 42) when the latching feature is desired. Yet another purpose of soft magnetic layers 31 and 32 is to confine the magnetic field inside the cavity enclosed by soft magnetic layers 31 and 32 so that the magnetic interference between adjacent devices can be eliminated or reduced. The distance between soft magnetic layer 31 (or 32) and first magnet 11 can be adjusted to alter the attractive force between the magnetic poles of magnet 11 and the soft magnetic layer 31 (or 32). Openings can also be suitably formed in soft magnetic layers 31 and 32 to achieve the same purpose.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on a substrate 33 by electroplating, deposition, screen printing, welding, lamination, or any other suitable means. Optional insulating layers (not shown) can be placed between the conducting layers to isolate electrical signals in some cases. Transmission-line types of contacts and metal traces can also be suitably designed and formed for high performance radio-frequency applications.

Substrate 33 can be any suitable structural material (plastic, ceramics, semiconductors, metal coated with thin films, etc.).

In a broad aspect of the invention, an electromagnet 20, when energized, produces a third magnetic field which is primarily perpendicular to the magnetization direction of first movable magnet 11 and exerts a magnetic torque on first magnet 11 to force first magnet 11 and body 10 to rotate and close an electrical conduction path at one end (e.g., first end) of body 10. Changing the direction of the electrical current in third electromagnet 20 changes the direction of the third magnetic field and thus the direction of the magnetic torque on first magnet 11, and causes first magnet 11 and body 10 to rotate in an opposite direction and opens the electrical conduction path at the end (e.g., first end) of body 10 and closes the electrical conduction path at the other end (e.g., second end).

With continued reference to FIGS. 1A and 1B, first magnet 11 is permanently magnetized horizontally (along positive x-axis) with a combined magnetization moment m. Movable body 10 can have three basic stable positions: (a) the first (right) end down (as shown); (b) the second (left) end down; and (c) neutral (approximately leveled) position. When a current passes through coil 20 (third electromagnet) as shown in FIG. 1B going into (circle with a cross) the paper on the left side and out (circle with a dot) from the paper on the right), a perpendicular third magnetic field ($H_s$, the solid line with an arrow pointing downward in this case) about first magnet 11 is produced. The third magnetic field $H_s$ interacts with first magnet 11 and exerts a magnetic torque ($\tau=\mu_0 m \times H_s$) on first magnet 11 and causes magnet 11 and body 10 to rotate clockwise until contact 13 touches contact 41 on the right-hand side, closing the electrical conduction path between contact 13 and contact 41. On the other hand, when the direction of the current in coil 20 is opposite to the direction shown in FIGS. 1A and 1B, the magnetic torque ($\tau$) on first magnet 11 is counterclockwise and causes first magnet 11 and body 10 to rotate counterclockwise until contact 14 touches contact 42 on the left-hand side, closing the electrical conduction path between contact 14 and contact 42 and opening the electrical conduction path between contact 13 and contact 41. Soft magnetic layers 31 and 32 wrap around coil 20 to form a closed magnetic circuit and enhance the coil-induced magnetic flux density (third vertical magnetic field) in body 10 region. When electromagnet 20 is not energized, body 10 can be in the neutral (leveled) position and maintained in that position by the restoring spring force of spring and support 12 and pivot 15, or remained in one of the tilted states (one end down) when the magnetic attraction between that end of first magnet 11 and soft magnetic layers 31 and 32 is strong enough to hold it there.

Some of the aforementioned advantages of the disclosed invention can be evidenced by the following exemplary analysis.

Example 1

Assuming the first magnet having the following characteristics: length=4 mm (along long axis), width=4 mm, thickness=0.2 mm, volume V=length×width×thickness, remnant magnetization $B_r=\mu_0 M=1$ T, the magnetic moment $\mu_0 m=\mu_0 M \times V=3.2\times10^{-9}$ T·m$^3$. For a coil-induced magnetic field $\mu_0 H_s=0.05$ T ($H_s=500$ Oe), the induced magnetic torque about the length center is $\tau=\mu_0 m \times H_s=1.27\times10^{-4}$ m·N (assuming m is perpendicular to $H_s$) which corresponds to a force of $F_m=\tau/(\text{length}/2)=6.4\times10^{-2}$ N at the end of the first magnet. The above exemplary parameters show that for a relatively small coil-induced magnetic field ($H_s=500$ Oe), a significantly large torque and force can be generated. The torque and force can continue to increase with larger $H_s$ (correspondingly larger coil current). Another point worth noting is that when the angle between m and $H_s$ changes from perfectly perpendicular (90°) to 80°, the change in the magnitude of the torque (and force) is only 1.5%=1−98.5%=1−sin(80°), which gives a larger tolerance in production variations, simplifies the production process, and reduces costs.

FIG. 2 shows an exemplary embodiment of a double-pole-double-throw (DPDT) electromechanical relay. In this embodiment, relay 200 has an upper part 200A and a lower part 200B, and comprises a movable body 10, a coil 20, soft magnetic layers 31 and 32, and electrical terminals p1, t11, t12, p2, t21, t22, c1, and c2, and bottom (stationary) electrical contacts b11, b12, b21, and b22, and a substrate 33.

Movable body 10 comprises a magnetic body 11 (first magnet), springs s1 and s2, top (movable) electrical contacts (not shown), and an over-mold 16. A pivot 15 is placed below movable body 10 for further support.

Magnetic body 11 (first magnet) comprises permanent (hard) magnetic material and is permanently magnetized primarily along the positive x-axis when said first magnet 11 lies leveled.

Springs s1 and s2 can be made from metal (e.g., BeCu, Ni, NiFe, etc.). Spring s1 is electrically connected to terminal p1 at w1 by spot welding, soldering, or other means. Spring s2 is electrically connected to terminal p2 at w2 by spot welding, soldering, or other means. Other locations for spring and terminal welding are also possible. Electrical contacts (not shown) are affixed (by spot welding, etc.) to the ends of springs s1 and s2 for making electrical contact to the bottom electrical contacts. The electrical contacts can be any electrically conducting layer such as Au, Ag, Rh, Ru, Pd, AgCdO, Tungsten, etc., or suitable alloys. Springs s1 and s2 are flexible so that they can bend (near their ends) and twist (in the section toward w1 and w2).

Over-mold 16 affixes magnetic body 11 and springs s1 and s2 together to form a unified body (movable body 10). Over-mold 16 can be made from plastic material such as liquid crystal polymers (LCP), or any other suitable molding material.

Pivot 15 can be formed by molding from the same substrate 33 or by shaping of soft magnet layer 31.

Movable Body 10 has a first (right) end associated with the first (right) end of first magnet 11 and contacts b11 and b21, and has a second (left) end associated with the second (left) end of first magnet 11 and contacts b12 and b22.

Coil 20 (third electromagnet) is formed by having multiple windings of conducting wires around body 10. The conducting wires can be any conducting materials such as Cu, Al, Au, or others. The windings can be formed by either winding the conducting wires around a bobbin, or by electroplating, deposition, screen printing, etching, laser forming, or other means used in electronics industry (e.g., semiconductor integrated circuits, printed circuit boards, etc.). One end of coil 20 is connected to terminal c1 and the other end of coil 20 is connected to terminal c2. Coil 20 is over-molded (molding 21) with a plastic material (LCP) or other suitable molding material. A cavity 22 is formed in molding 21 to allow movable body 20 (including springs s1 and s2) to rotate or move. One purpose of coil 20 in relay 200, when energized, is to provide a third vertical (along y-axis) magnetic field ($H_s$) so that a magnetic torque ($\tau=\mu_0 m \times H_s$) can be created on first magnet 11 to cause movable body 10 to rotate.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. In this embodiment, soft magnetic layer 31 is placed below first magnet 11 and soft magnetic layer 32 is placed above first magnet 11.

Electrical terminals p1, t11, t12, p2, t21, t22, c1, and c2 can be any electrically conducting material such as Copper, NiFe, Ni, Steel, etc. All or part of the electrical terminals can be molded with substrate 33. Various patterns can be formed on the layer that forms the electrical terminals so that each terminal can extend from the outside edges of relay 200 into the inside to form electrical contact pads and conduction paths.

Bottom (stationary) electrical contacts b11, b12, b21, b22 can be any electrically conducting layer such as Au, Ag, Rh, Ru, Pd, AgCdO, Tungsten, etc., or suitable alloys. Bottom electrical contact b11 is connected to terminal t11 and bottom electrical contact b12 is electrically connected to terminal t12. Bottom electrical contact b21 is connected to terminal t21 and bottom electrical contact b22 is electrically connected to terminal t22.

Substrate 33 can be any suitable structural material (plastic, ceramics, metal coated with thin films, etc.).

Upper body 200A and lower body 200B are assembled together to form relay 200. Epoxy or other types of glues can be applied at the bottom to seal relay 200. A small hole can be formed in substrate 33 or molding 21 and later sealed. Additional capping covers (made of metal or plastic material, etc.) can be added for magnetic and electronic screening or for encapsulation purposes.

In a broad aspect of the invention, coli 20, when energized, produces a third magnetic field which is primarily perpendicular to the magnetization direction of first movable magnet 11 and exerts a magnetic torque on first magnet 11 to force first magnet 11 and body 10 to rotate and close electrical conduction paths at one end (e.g., first end) of body 10. Changing the direction of the electrical current in third electromagnet 20 changes the direction of the third magnetic field and thus the direction of the magnetic torque on first magnet 11, and causes first magnet 11 and body 10 to rotate in an opposite direction and opens the electrical conduction path at one end (e.g., first end) of body 10 and closes the electrical conduction paths at the other end (e.g., second end).

When electromagnet 20 is not energized, body 10 can be in the neutral (leveled) position and maintained in that position by the restoring spring force of the springs (s1 and s2) and pivot 15, or remains in one of the tilted states (one end down) when the magnetic attraction between that end of first magnet 11 and soft magnetic layer 31 (and/or soft magnetic layer 32) is strong enough to hold it there.

When movable body 10 is rotated clockwise and its first end (right end) touches down, the electrical conduction path from terminal p1 to terminal t11 is closed through top contacts at the right end of spring s1 and contact b11, and the electrical conduction path from terminal p2 to terminal t21 is closed through top contacts at the right end of spring s2 and contact b21. Electrical conduction paths between terminal p1 and t12 and electrical conduction paths between terminal p2 and t22 are open.

When movable body 10 is rotated counterclockwise and its second end (left end) touches down, the electrical conduction path from terminal p1 to terminal t12 is closed through top contacts at the left end of spring s1 and contact b12, and the electrical conduction path from terminal p2 to terminal t22 is closed through top contacts at the left end of spring s2 and contact b22. Electrical conduction paths between terminal p1 and t11 and electrical conduction paths between terminal p2 and t21 are open.

FIG. 3 shows another exemplary embodiment of a double-pole-double-throw (DPDT) electromechanical relay. In this embodiment, relay 300 has an upper part 300A and a lower part 300B, and comprises a movable body 10, a coil 20, soft magnetic layers 31 and 32, and electrical terminals p1, t11, t12, p2, t21, t22, c1, and c2, and bottom (stationary) electrical contacts b11, b12, b21, and b22, and a substrate 33. In this embodiment, coil 20 is placed in lower part 300B.

Movable body 10 comprises a magnetic body 11 (first magnet), springs s1 and s2, top (movable) electrical contacts (not shown), and an over-mold 16. A pivot 15 is placed below movable body 10 for further support.

Magnetic body 11 (first magnet) comprises permanent (hard) magnetic material and is permanently magnetized primarily along the positive x-axis when said first magnet 11 lies leveled.

Springs s1 and s2 can be made from metal (e.g., BeCu, Ni, NiFe, etc.). Spring s1 is electrically connected to terminal p1 at w1 by spot welding, soldering, or other means. Spring s2 is electrically connected to terminal p2 at w2 by spot welding, soldering, or other means. Other locations for spring and terminal welding are also possible. Electrical contacts (not shown) are affixed (by spot welding, etc.) to the ends of springs s1 and s2 for making electrical contact to the bottom electrical contacts. The electrical contacts can be any electrically conducting layer such as Au, Ag, Rh, Ru, Pd, AgCdO, Tungsten, etc., or suitable alloys. Springs s1 and s2 are flexible so that they can bend (near their ends) and twist (in the section toward w1 and w2).

Over-mold 16 affixes magnetic body 11 and springs s1 and s2 together to form a unified body (movable body 10). Over-mold 16 can be made from plastic material such as liquid crystal polymers (LCP), or any other suitable molding material.

Pivot 15 can be formed by molding from the same substrate 33 or by shaping of soft magnet layer 31.

Movable Body 10 has a first (right) end associated with the first (right) end of first magnet 11 and contacts b11 and b21, and has a second (left) end associated with the second (left) end of first magnet 11 and contacts b12 and b22.

Coil 20 (third electromagnet) is formed by having multiple windings of conducting wires around body 10. The conducting wires can be any conducting materials such as Cu, Al, Au, or others. The windings can be formed by either winding the conducting wires around a bobbin, or by electroplating, deposition, screen printing, etching, laser forming, or other means used in electronics industry (e.g., semiconductor integrated circuits, printed circuit boards, etc.). One end of coil 20 is connected to terminal c1 and the other end of coil 20 is connected to terminal c2. Coil 20 is placed or over-molded in substrate 33. One purpose of coil 20 in relay 300, when energized, is to provide a third vertical (along y-axis) magnetic field ($H_s$) so that a magnetic torque ($\tau=\mu_0 m \times H_s$) can be created on first magnet 11 to cause movable body 10 to rotate.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. In this embodiment, soft magnetic layer 31 is placed below first magnet 11 and soft magnetic layer 32 is placed above first magnet 11.

Electrical terminals p1, t11, t12, p2, t21, t22, c1, and c2 can be any electrically conducting material such as Copper, NiFe, Ni, Steel, etc. All or part of the electrical terminals can be molded with substrate 33. Various patterns can be formed on the layer that forms the electrical terminals so that each terminal can extend from the outside edges of relay 200 into the inside to form electrical contact pads and conduction paths.

Bottom (stationary) electrical contacts b11, b12, b21, b22 can be any electrically conducting layer such as Au, Ag, Rh, Ru, Pd, AgCdO, Tungsten, etc., or suitable alloys. Bottom electrical contact b11 is connected to terminal t11 and bottom electrical contact b12 is electrically connected to terminal t12. Bottom electrical contact b21 is connected to terminal t21 and bottom electrical contact b22 is electrically connected to terminal t22.

Substrate 33 can be any suitable structural material (plastic, ceramics, metal coated with thin films, etc.).

Upper part 300A and lower part 300B are assembled together to form relay 300. Epoxy or other types of glues can be applied at the bottom to seal relay 300. A small hole can be formed in substrate 33 or molding 61 and later sealed. Additional capping covers (made of metal or plastic material, etc.) can be added for magnetic and electronic screening or for encapsulation purposes.

In a broad aspect of the invention, coli 20, when energized, produces a third magnetic field which is primarily perpendicular to the magnetization direction of first movable magnet 11 and exerts a magnetic torque on first magnet 11 to force first magnet 11 and body 10 to rotate and close electrical conduction paths at one end (e.g., first end) of body 10. Changing the direction of the electrical current in third electromagnet 20 changes the direction of the third magnetic field and thus the direction of the magnetic torque on first magnet 11, and causes first magnet 11 and body 10 to rotate in an opposite direction and opens the electrical conduction path at one end (e.g., first end) of body 10 and closes the electrical conduction paths at the other end (e.g., second end).

When electromagnet 20 is not energized, body 10 can be in the neutral (leveled) position and maintained in that position by the restoring spring force of the springs (s1 and s2) and pivot 15, or remains in one of the tilted states (one end down) when the magnetic attraction between that end of first magnet 11 and soft magnetic layer 31 (and/or soft magnetic layer 32) is strong enough to hold it there.

When movable body 10 is rotated clockwise and its first end (right end) touches down, the electrical conduction path from terminal p1 to terminal t11 is closed through top contacts at the right end of spring s1 and contact b11, and the electrical conduction path from terminal p2 to terminal t21 is closed through top contacts at the right end of spring s2 and contact b21. Electrical conduction paths between terminal p1 and t12 and electrical conduction paths between terminal p2 and t22 are open.

When movable body 10 is rotated counterclockwise and its second end (left end) touches down, the electrical conduction path from terminal p1 to terminal t12 is closed through top contacts at the left end of spring s1 and contact b12, and the electrical conduction path from terminal p2 to terminal t22 is closed through top contacts at the left end of spring s2 and contact b22. Electrical conduction paths between terminal p1 and t11 and electrical conduction paths between terminal p2 and t21 are open.

It is understood that a variety of methods can be used to fabricate the DPDT electromechanical relay. It will be understood that many other embodiments and combinations of different choices of materials and arrangements could be formulated without departing from the scope of the invention. Similarly, various topographies and geometries of the electromechanical relay could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

REFERENCE

[1] Engineers' Relay Handbook, 5th Edition, published by National Association of Relay Manufacturers, 1996.
[2] U.S. Pat. No. 5,818,316, Shen et al.
[3] U.S. Pat. No. 6,469,602 B2, Ruan and Shen.
[4] U.S. Pat. No. 6,124,650, Bishop et al.
[5] U.S. Pat. No. 6,469,603 B1, Ruan and Shen.
[6] U.S. Pat. No. 5,398,011, Kimura et al.
[7] U.S. Pat. No. 5,847,631, Taylor and Allen.
[8] U.S. Pat. No. 6,094,116, Tai et al.
[9] U.S. Pat. No. 6,084,281, Fullin et al.
[10] U.S. Pat. No. 5,475,353, Roshen et al.
[11] U.S. Pat. No. 5,703,550, Pawlak et al.
[12] U.S. Pat. No. 5,945,898, Judy et al.
[13] U.S. Pat. No. 6,143,997, Feng et al.
[14] U.S. Pat. No. 6,794,965 B2, Shen et al.
[15] U.S. Pat. No. 7,482,899 B2.

What is claimed is:

1. An electromechanical relay, comprising:

a substrate, wherein said substrate comprising a first set of stationary contacts and a second set of stationary contacts;

a movable body attached to said substrate having a rotational axis; said movable body having a first end and a first set of movable contacts associated to said first end, and a second end and a second set of movable contacts associated to said second end; and said movable body further comprising a first magnet having a permanent magnetization moment and a set of springs; wherein said first magnet and said set of springs being affixed together by over-mold forming a unified body;

a switching magnet having a coil, wherein passing a current through said coil generating a switching magnetic field which has a main component primarily perpendicular to said permanent magnetization moment in the region where said switching magnetic field goes through said first magnet, and as a result of the vector-cross product of said switching magnetic field and said permanent magnetization moment producing a torque on said first magnet and causing said movable body to rotate about said rotational axis;

an over-mold housing comprising a top cover, and an enclosing side wall wherein said coil being embedded in said enclosing side wall; wherein said over-mold housing being a unified body and comprising soft magnet material;

wherein said substrate and said over-mold housing forming a cavity for encasing said movable body;

wherein said switching magnet is controllable to cause said movable body settling in a stable state related to said substrate wherein said stable state is selected from:

a) said first set of movable contacts being in contact with said first set of stationary contacts and said second set of movable contacts being separated from said second set of stationary contacts;

b) said first set of movable contacts being separated from said first set of stationary contacts and said second set of movable contacts being in contact with said second set of stationary contacts; or c) said first set of movable contacts being separated from said first set of stationary contacts and said second set of movable contacts being separated from said second set of stationary contacts.

2. An electromechanical relay according claim 1, wherein said first magnet comprises permanent magnetic material.

3. An electromechanical relay according claim 1, wherein said first magnet comprises soft magnetic material.

4. An electromechanical relay according claim 1, wherein said substrate comprises soft magnetic material.

5. An electromechanical relay according claim 1, wherein said first magnet is sandwiched by soft magnetic material.

6. An electromechanical relay according claim 1, which is a double-pole-double-throw electromechanical relay.

7. An electromechanical relay according claim 1, which is a multi-pole-multi-throw electromechanical relay.

8. An electromechanical relay according claim 4, wherein said soft magnet material in said substrate and said soft material in said over-mold housing being magnetically connected for forming an soft magnet circuit.

9. An electromechanical relay, comprising:

a substrate, wherein said substrate comprising a first set of stationary contacts and a second set of stationary contacts;

a movable body attached to said substrate having a rotational axis; said movable body having a first end and a first set of movable contacts associated to said first end, and a second end and a second set of movable contacts associated to said second end; and said movable body further comprising a first magnet having a permanent magnetization moment and a set of springs; wherein said first magnet and said set of springs being affixed together by over-mold forming a unified body;

a switching magnet having a coil, wherein passing a current through said coil generating a switching magnetic field which has a main component primarily perpendicular to said permanent magnetization moment in the region where said switching magnetic field goes through said first magnet, and as a result of the vector-cross product of said switching magnetic field and said permanent magnetization moment producing a torque on said first magnet and causing said movable body to rotate about said rotational axis;

wherein said substrate being affixed with an enclosing side wall by over molding for forming a over-mold housing; wherein said coil being embedded in said enclosing side wall; wherein said over-mold housing being a unified body and comprising soft magnet material;

a top cover comprising soft magnet material; wherein said top cover and said over-mold housing forming a cavity for encaging said movable body;

wherein said switching magnet is controllable to cause said movable body settling in a stable state related to said substrate wherein said stable state is selected from:

a) said first set of movable contacts being in contact with said first set of stationary contacts and said second set of movable contacts being separated from said second set of stationary contacts;

b) said first set of movable contacts being separated from said first set of stationary contacts and said second set of movable contacts being in contact with said second set of stationary contacts; or c) said first set of movable contacts being separated from said first set of stationary contacts and said second set of movable contacts being separated from said second set of stationary contacts.

10. An electromechanical relay according claim 9, wherein said first magnet comprises permanent magnetic material.

11. An electromechanical relay according claim 9, wherein said first magnet comprises soft magnetic material.

12. An electromechanical relay according claim 9, wherein said substrate comprises soft magnetic material.

13. An electromechanical relay according claim 9, wherein said first magnet is sandwiched by soft magnetic material.

14. An electromechanical relay according claim 9, which is a double-pole-double-throw electromechanical relay.

15. An electromechanical relay according claim 9, which is a multi-pole-multi-throw electromechanical relay.

16. An electromechanical relay according claim 9, wherein said soft magnet material in said substrate and said soft material in said over-mold housing being magnetically connected for forming an soft magnet circuit.

* * * * *